US005729505A

United States Patent [19]

Murata et al.

[11] Patent Number: 5,729,505

[45] Date of Patent: Mar. 17, 1998

[54] IGNITION DEVICE FOR AN INTERNAL COMBUSTION ENGINE

[75] Inventors: Shigemi Murata; Mitsuru Koiwa, both of Tokyo, Japan

[73] Assignee: Mitsubishi Denki Kabushiki Kaisha, Tokyo, Japan

[21] Appl. No.: 605,897

[22] Filed: Feb. 23, 1996

[30] Foreign Application Priority Data

May 8, 1995 [JP] Japan ..... 7-109607

[51] Int. Cl.[6] ..... H01F 27/30; F02P 11/00

[52] U.S. Cl. ..... 336/178; 123/644; 123/634; 123/647

[58] Field of Search ..... 336/96, 178, 107, 336/192; 123/634, 620, 647, 169 PA, 644

[56] References Cited

U.S. PATENT DOCUMENTS 2,904,763 9/1959 Harruff .
3,935,852 2/1976 Donovan ..... 123/148 A
4,248,201 2/1981 Tsutsui et al. ..... 123/647
5,172,302 12/1992 Taruya et al. ..... 361/386

FOREIGN PATENT DOCUMENTS 2842081 4/1979 Germany .
64-8580 1/1989 Japan .

*Primary Examiner*—Peter S. Wong
*Assistant Examiner*—Rajnikant B. Patel
*Attorney, Agent, or Firm*—Sughrue, Mion, Zinn, Macpeak & Seas, PLLC

[57] ABSTRACT

An ignition device for an internal combustion engine in which an iron coil is easily and securely grounded. In the ignition device, an ignition coil includes an iron core formed by laminating a plurality of cut steel plates; a primary coil wound around the iron core; a secondary coil wound around the primary coil; and a conductive plate being arranged between the iron core and a primary bobbin of the primary coil, having a contact surface with which sections of the steel plates are in contact and being electrically connected to a ground terminal of an external terminal.

11 Claims, 6 Drawing Sheets

IGNITION DEVICE FOR AN INTERNAL COMBUSTION ENGINE

BACKGROUND OF THE INVENTION

1. Field of the Invention

This invention relates to an ignition device for an internal combustion engine which generates high voltage in the secondary coil from the primary current passing through the primary coil of the ignition coil, and supplies the high voltage to an ignition plug of an internal combustion engine.

2. Description of the Related Art

FIG. 7 is a sectional side view showing a main part of a conventional ignition device for an internal combustion engine. FIG. 8 is a sectional view taken along the lines VIII—VIII of FIG. 7. A square hole 4*a* is formed in the bottom of a bottomed prism-shaped insulating case 4 of an ignition coil 100. A primary coil 2 is wound around a prism-shaped primary bobbin 2*a*. In the insulating case 4, a central axis of the primary bobbin 2*a* coincides with that of the hole 4*a* of the insulating case 4, and a flange 2*c* of one end of the primary bobbin 2*a* is arranged for abutting against the bottom face of the insulating case 4. A secondary coil 3 wound around a secondary bobbin 3*a* is arranged around the primary coil 2 with maintaining a constant distance therefrom. A hole 4*b* is formed in the lower (in FIG. 7) side wall of the insulating case 4. On the outside of the side wall, a cylindrical high voltage tower 6*a* extends vertically from the hole 4*b* so as to be integral with the insulating case 4. One end of a high voltage terminal 6 is connected to a high voltage generating end 3*b* of the secondary coil 3, and the other end extends into the high voltage tower 6*a*. In order to insulate the high voltage terminal 6 from outside, an insulating rubber 6*b* is arranged around the high voltage tower 6*a*. After being arranged in the insulating case 4, each of the above parts such as the primary coil 2 and the secondary coil 3 are secured by resin 7 which is injected and hardened between them. An external terminal 5 is provided on one side wall of the opening side of the insulating case 4.

An iron core 1, forming a closed magnetic circuit, is composed of two substantially U-shaped iron core sections 1*a* and 1*b*. One of these ends of the core sections 1*a* and 1*b*, which face each other, is inserted into the primary bobbin 2*a* and secured by an adhesive, the other ends being welded at their respective ends at positions exposed from the insulating case 4. A mounting hole 1*d* is formed in the iron core 1 for securing the ignition coil 100 to the internal combustion engine, and the ignition coil 100 is secured to mountings 9 by mounting bolts 8. A metal plate 10 is arranged on the upper portion of the mounting hole 1*d* of the iron core 1, and secured to the iron core 1 by the mounting bolts 8. The metal plate 10 is grounded through a ground terminal 5*b* provided on the external terminal 5.

FIG. 9 is a partial front view showing the iron core of the conventional ignition device for the internal combustion engine. FIG. 10 is a sectional view taken along the lines X—X of FIG. 9. The iron core 1 is formed of laminated silicon steel plates 1*g* each having a thickness of about 0.3 to 0.5 mm. Each of the silicon steel plates 1*g* are formed by cutting a large silicon steel plate material having an insulating film formed on the surface thereof into predetermined shapes. Therefore, no insulating film is formed on each section 1*h*. A resin coating film 1*f* is usually coated on a portion of the iron coil 1 exposed to the outside, other than the portions stored in the primary bobbin 2*a*, for preventing rust from forming.

FIG. 11 is an electric circuit diagram of the conventional ignition device for the internal combustion engine. An ignition signal input terminal 13 is connected to a base of a power switch 14, which is a transistor, and the primary coil 2 wound around the iron core 1 is connected to a collector of the power switch 14. The iron core 1 and an emitter of the power switch 14 are connected to the ground terminal 5*b*. The high voltage side of the secondary coil 3 wound around the primary coil 2 is connected to the high voltage terminal 6.

According to the ignition device for an internal combustion engine constructed as described above, an ignition signal from a control unit (not shown), which is input from the ignition signal input terminal 13, controls the primary current passing through the primary coil 2 of the ignition coil through the power switch 14. High voltage is generated in the secondary coil 3 of the ignition coil depending on the current passing through the primary coil 2, and the high voltage is supplied to an ignition plug of the internal combustion engine (not shown) through the high voltage terminal.

As described above, according to the conventional ignition device for an internal combustion engine, the insulating film (not shown) provided on the surface of the silicon steel plate 1*g* and the resin coating film 1*f* applied to prevent rust from occurring are formed on the surface of the portion of the iron core 1 exposed to the outside, other than the portions stored in the primary bobbin 2*a*. Therefore, when the metal plate 10 is secured to the surface, the iron core 1 is not securely grounded through the metal plate and the ground terminal 5*b*, and the high voltage generated in the secondary coil 3 is induced in the iron core 1 to cause electrical discharge between the iron core 1 and a low-pressure area near the mounting portions of the iron core 1. The electrical discharge generates noise to interfere with the operation of various devices and increases radio noises. In addition, there is a problem that when performing maintenance of the internal combustion engine, a person may receive an electric shock if the iron core 1 in which high voltage is induced is touched.

On the other hand, the resin coating film 1 and the insulating film must be partially eliminated to ground the iron core 1 securely. This increases the number of man-hours, and causes an increase in cost.

SUMMARY OF THE INVENTION

Accordingly, in order to overcome the above drawbacks, an object of the present invention is to provide an ignition device for an internal combustion engine which can ground an iron core easily and securely without increasing the number of man-hours.

According to an aspect of the present invention, there is provided an ignition device for an internal combustion engine, wherein an ignition coil comprises an iron core formed by laminating a plurality of cut steel plates; a primary coil wound around the iron core; a secondary coil wound around the primary coil; and a conductive plate being arranged between the iron core and a primary bobbin of the primary coil, having a contact surface with which sections of the steel plates are in contact and being electrically connected to a ground terminal of an external terminal.

DESCRIPTION OF THE PREFERRED EMBODIMENTS

First Embodiment

Figure 1:
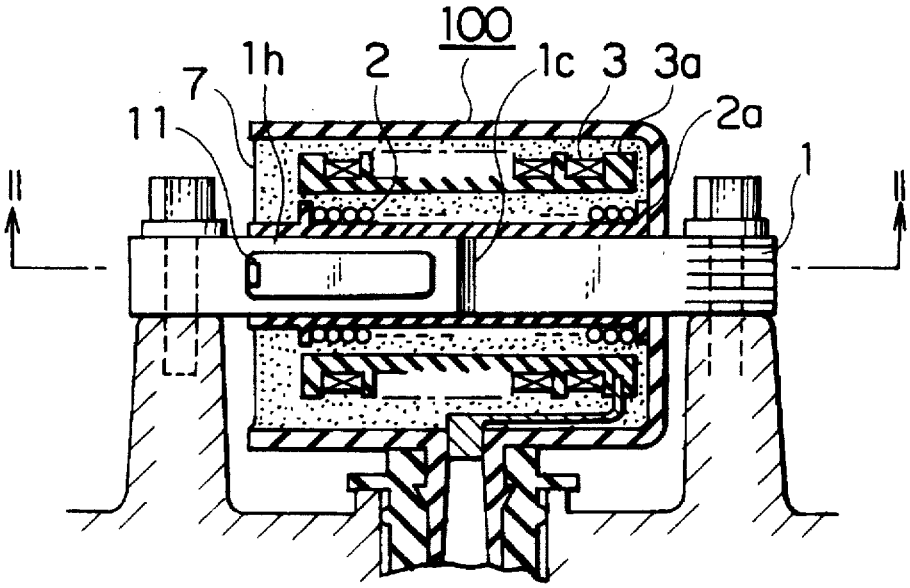
FIG. 1 is a sectional side view showing a main part of an ignition device for an internal combustion engine according to an embodiment of the present invention.
Figure 2:
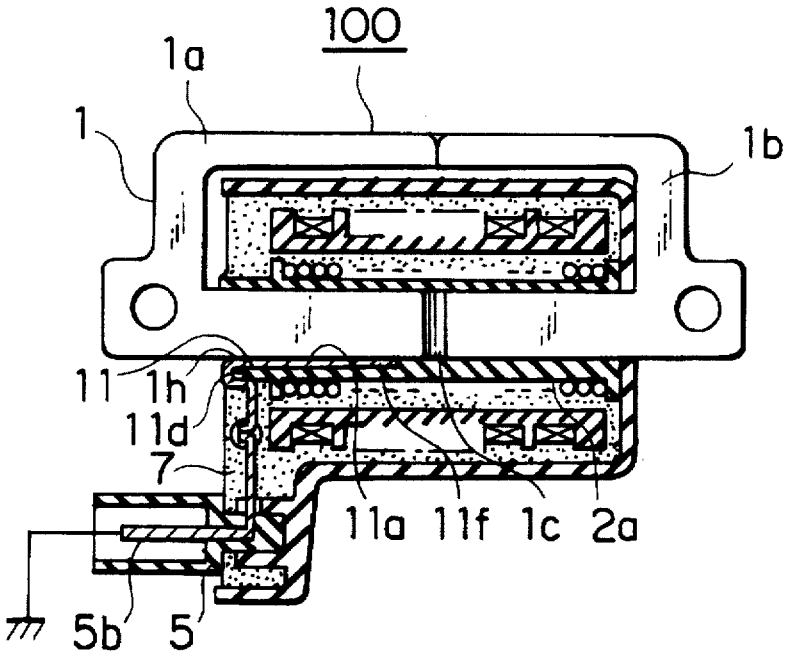
FIG. 2 is a sectional view taken along the line II—II of FIG. 1.

FIG. 1 is a sectional side view showing a main part of an ignition device for an internal combustion engine according to an embodiment of the present invention. FIG. 2 is a sectional view taken along the lines II—II of FIG. 1. Referring to the drawings, the same or corresponding components as those of the conventional ignition device for an internal combustion device shown in FIGS. 7 to 13 are indicated by the same reference numerals, and description thereof will be omitted.

A substantially sheet-like conductive plate 11 is in contact with an iron core 1 of an ignition coil 100. A main part 11*f* of the conductive plate 11 is sandwiched between the iron core 1 and the primary bobbin 2*a* inside the primary bobbin 2*a* in which the iron core 1 is stored, and a clamping portion 11*d* is secured to the edge of the primary bobbin 2*a*. A portion of the iron core with which the conductive plate is in contact is a series of sections 1*h* of laminated silicon steel plates 1*g*, and no insulating film is formed thereon. A resin coating film 1*f* is not formed on a portion of the iron core 1 stored in the primary bobbin 2*a* as in the case of the conventional device illustrated in FIGS. 7 and 8. Therefore, the material is exposed to the portion of the iron core 1 with which the conductive plate 11 is in contact, whereby the iron core 1 is electrically securely connected to the conductive plate 11 through the contact thereof. The conductive plate 11 is connected to the ground terminal 5*b* provided on the external terminal 5 and grounded through external wiring.

In the ignition device for an internal combustion engine constructed as described above, the conductive plate 11 is in contact with the sections of the steel plates of the iron core 1 having no resin coating film 1*f* and insulating film formed thereon. Therefore, the iron core 1 can be securely grounded without requiring partial elimination of the resin coating film 1*f* and insulating film, whereby the number of man-hours is not increased, thus preventing an increase in cost.

Second Embodiment

Figure 3:
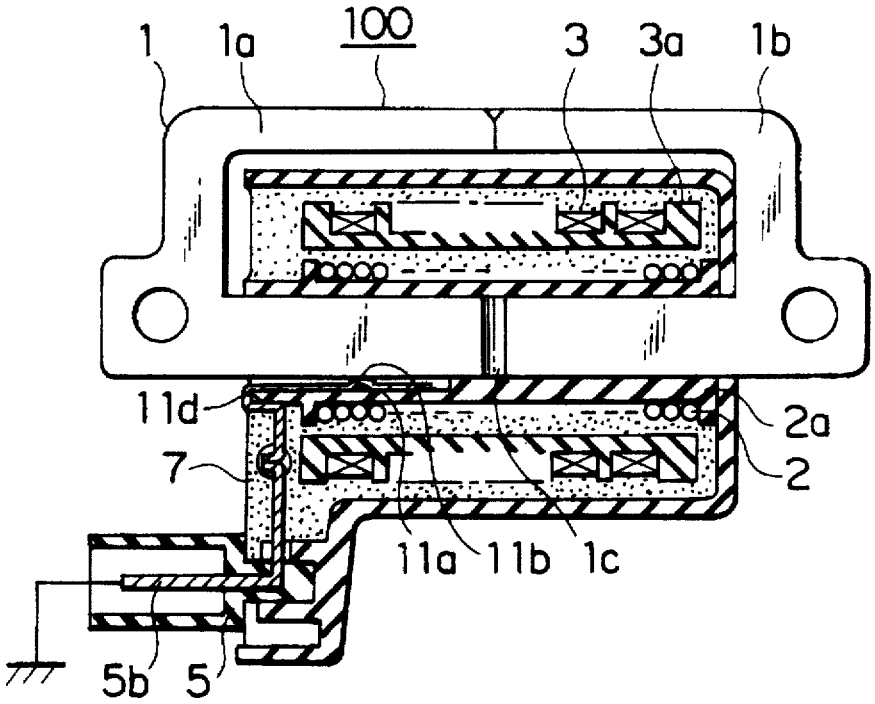
FIG. 3 is a sectional side view showing a main part of an ignition device for an internal combustion engine according to another embodiment of the present invention.

FIG. 3 is a sectional side view showing a main part of an ignition device for an internal combustion engine according to another embodiment of the present invention. Referring to FIG. 3, a raised portion 11*b* is provided in substantially center of a contact surface 11*a* of the conductive plate 11 with which the iron core 1 is in contact. The raised portion 11*b* is formed by corrugating the conductive plate 11. Therefore, the conductive plate 11 elastically comes into contact with the iron core 1, thereby further ensuring electrical contact between the iron core 1.

Third Embodiment

Figure 4:
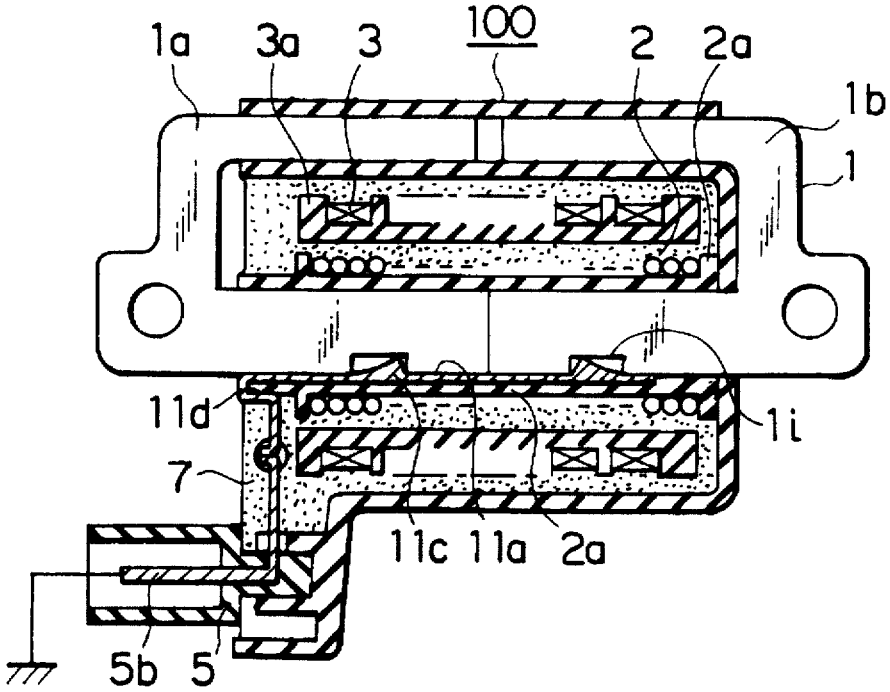
FIG. 4 is a sectional side view showing a main part of an ignition device for an internal combustion engine according to a still another embodiment of the present invention.
Figure 5:
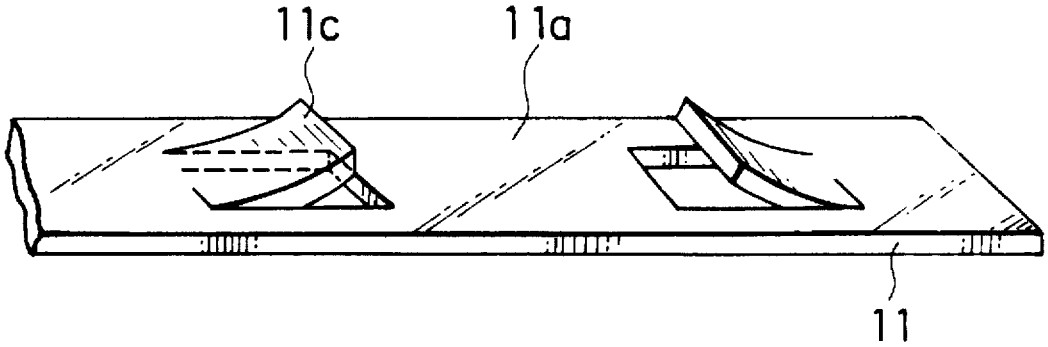
FIG. 5 is a general perspective view of a conductive plate of FIG. 4.

FIG. 4 is a sectional side view showing a main part of an ignition device for an internal combustion engine according to a another embodiment of the present invention. FIG. 5 is a detailed perspective view of the conductive plate of FIG. 4. Two raised portions 11*c* are formed on the contact surface 11*a* of the conductive plate 11 with which the iron core 1 is in contact. These raised portions 11*c* are formed by providing U-shaped notches in the contact surface 11*a* and bending the inner portions of the notches toward the contact surface 11*a* side. In the surface of the iron core 1 facing the conductive plate 11, recessed portions 1*i* are provided at positions corresponding to those of the raised portions 11*c*. The raised portions 11*c* and the recessed portions 1*i* constitute engaging means, and the raised portions 11*c* are stored in the recessed portions 1*i* to be engaged therewith. Therefore, tip corners of the raised portions 11*c* sharply come into contact with the iron core 1, thereby further ensuring electrical contact.

In an assembly step of the ignition device for an internal combustion engine, according to the conventional method, one of the ends of two U-shaped core sections 1*a* and 1*b* is inserted into the primary bobbin 2*a* and secured by an adhesive and then, the other ends are welded. This method, however, leads to falling off of the iron core between an adhesion step and the welding step.

According to this embodiment, the conductive plate 11 is arranged in the primary bobbin 2*a*, fixed at the clamping portion 11*d* by clamping the edge of the primary bobbin 2*a*, and secured by the resin 7. Thereafter, one of the ends of two iron core sections 1*a* and 1*b* of FIG. 4, which face each other, is inserted into the primary bobbin 2*a* and secured by an adhesive. Therefore, the raised portions 11*c* secure the iron core 1 to the position thereof to prevent the iron core 1 from falling out of the primary bobbin 2*a*. As the engaging means, the raised portions may be provided at the iron core 1 side and the recessed portions may be provided at the conductive plate 11 side.

Fourth Embodiment

Figure 6:
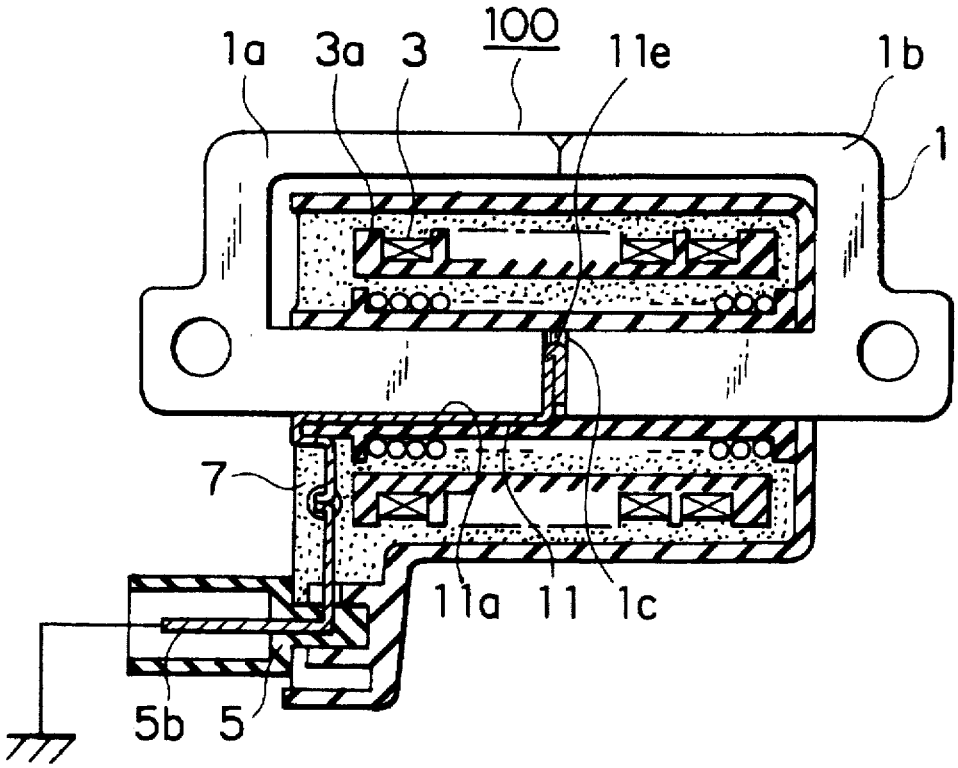
FIG. 6 is a sectional side view showing a main part of an ignition device for an internal combustion engine according to a further embodiment of the present invention.
Figure 7:
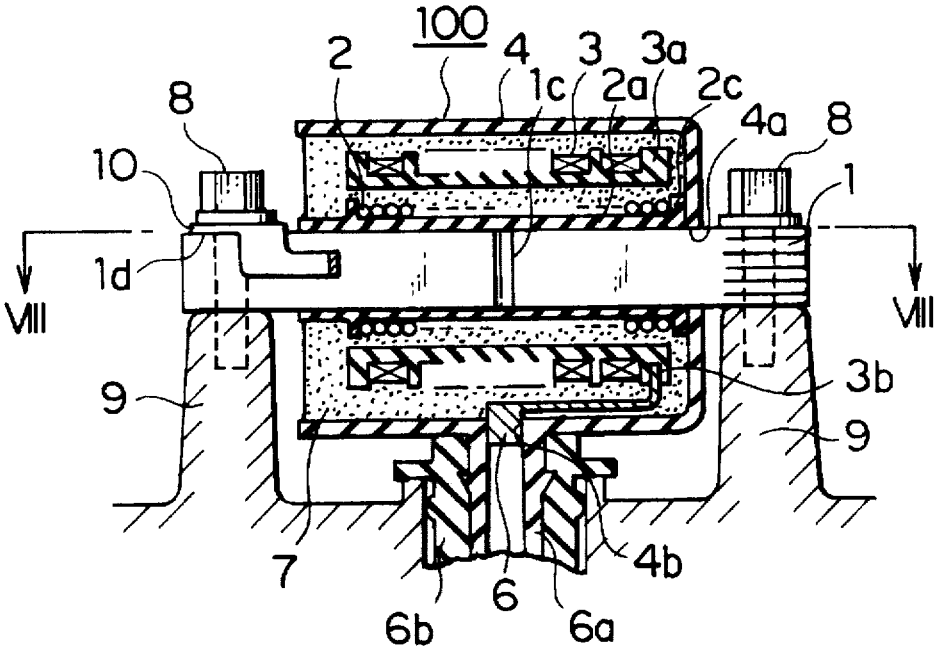
FIG. 7 PRIOR ART
FIG. 7 is a sectional side view showing a main part of a conventional ignition device for an internal combustion engine.
Figure 8:
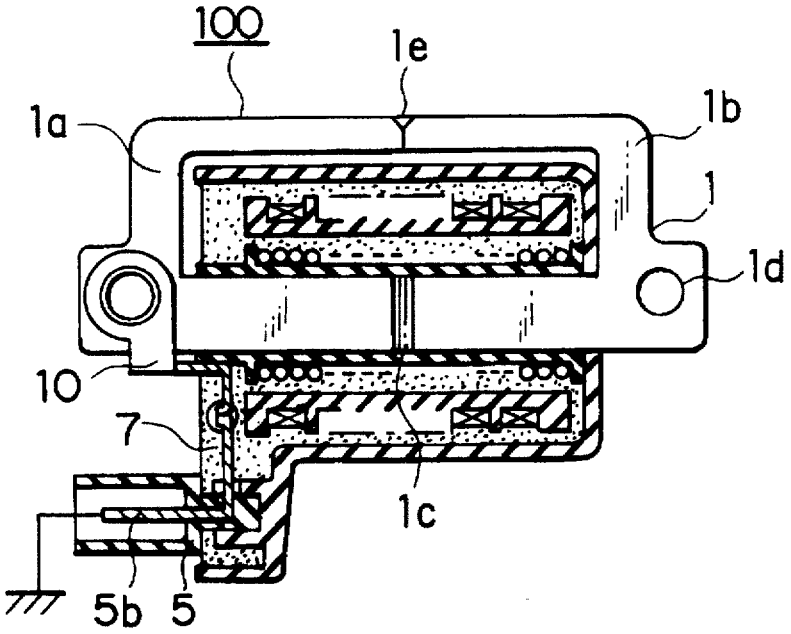
FIG. 8 PRIOR ART
FIG. 8 is a sectional view taken along the lines VIII—VIII of FIG. 7.
Figure 9:
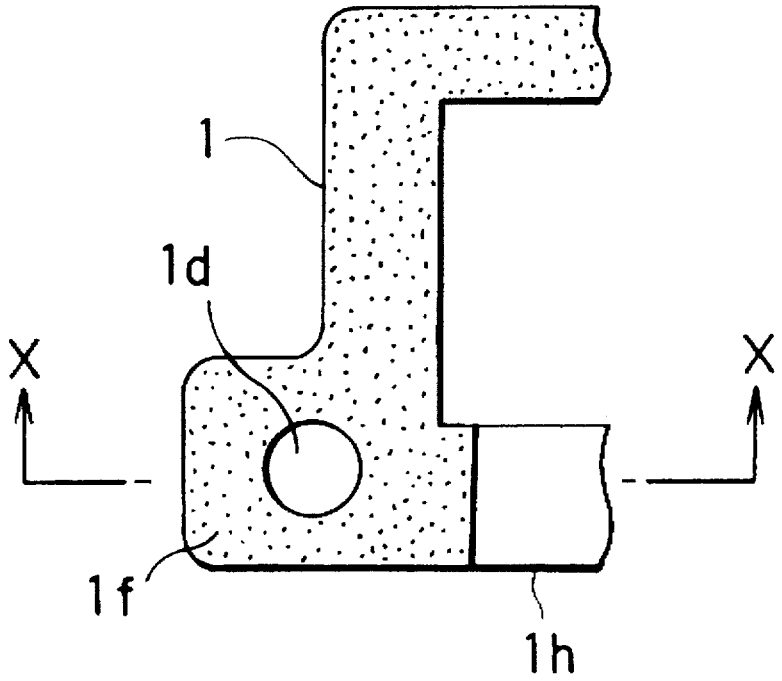
FIG. 9 PRIOR ART
FIG. 9 is a partial front view showing an iron core of the conventional ignition device for an internal combustion engine.
Figure 10:
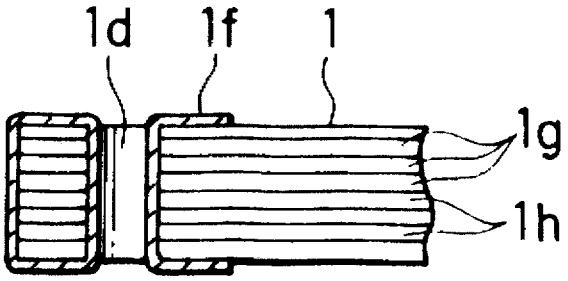
FIG. 10 PRIOR ART
FIG. 10 is a sectional view taken along the lines X—X of FIG. 9.
Figure 11:
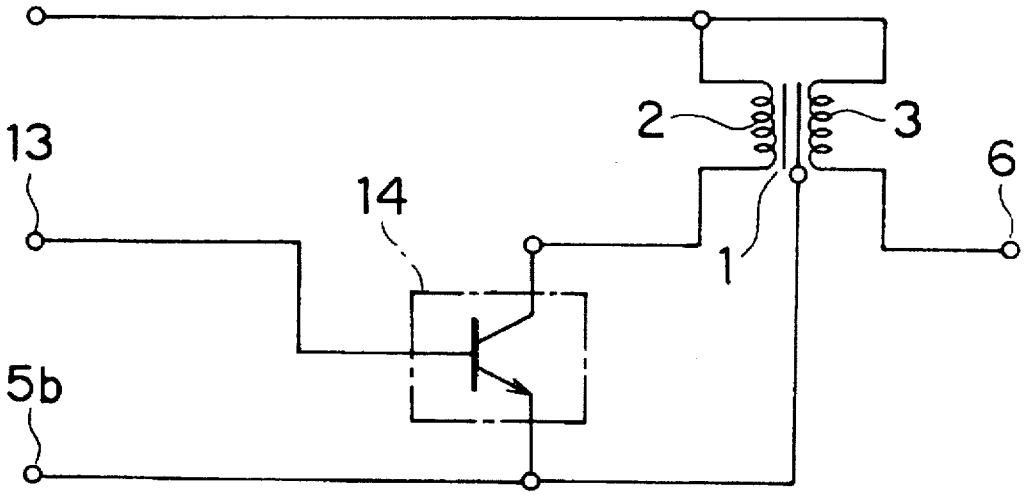
FIG. 11 PRIOR ART
FIG. 11 is an electric circuit diagram of the conventional ignition device for an internal combustion engine.

FIG. 6 is a sectional side view showing a main part of an ignition device for an internal combustion engine according to a further embodiment of the present invention. Referring to FIG. 6, the tip of the conductive plate 11 is, for example, folded back to form a gap holding portion 11*e* in order to meet the size of a gap 1*c* of the iron core 1. The gap holding portion 11*e* is bent at the right angle from a main part of the conductive plate 11 and positioned in the gap 1*c* of the iron core 1. In this case, the conductive plate 11 is formed of a non-magnetic material so as not to disturb a magnetic field of the iron core 1.

Since the size of the gap 1*c* of the iron core 1 sensitively affect output voltages of the secondary coil 3, a severe control thereof is required in view of the performance of the ignition device for an internal combustion engine. Conventionally, as one of the methods of size control, there is a method where a spacer is inserted in the gap 1*c* during assembly of the ignition device for the internal combustion engine. According to the ignition device for an internal combustion engine of this embodiment, the gap holding portion 11*e* of the conductive plate 11 for grounding the iron core 1 also acts as a spacer. Therefore, the size of the gap 1*c* can be controlled. In addition, since the conductive plate 11 is formed of a non-magnetic material, it neither affects the magnetic field of the iron core 1 nor disturbs magnetic properties of the iron core 1.

In one form of the invention, there is provided an ignition device for an internal combustion engine, wherein an ignition coil comprises an iron core formed by laminating a plurality of cut steel plates; a primary coil wound around the iron core; a secondary coil wound around the primary coil; and a conductive plate being arranged between the iron core and a primary bobbin of the primary coil, having a contact surface with which sections of the steel plates are in contact and being electrically connected to a ground terminal of an external terminal. This feature of the invention offers the following advantages. The conductive plate comes into contact with sections having no coating film formed thereon of the steel plates which constitutes the iron core. Therefore, the conductive plate is securely electrically connected to the iron core. Since the conductive plate is connected to a ground terminal, the iron core is electrically connected to the ground terminal so as to be securely grounded.

In another form of the invention, there is provided an ignition device for an internal combustion engine, wherein a raised portion is provided on the contact surface. This feature of the invention offers the following advantage. The raised portion elastically comes into contact with the contact surface and securely abuts against the iron core, whereby the iron core is grounded further securely.

In a still another form of the invention, there is provided an ignition device for an internal combustion engine, wherein said iron core and said conductive plate have engaging means. This feature of the invention offers the following advantages. The conductive plate is engaged with the iron core, and the conductive plate secures the iron core to the position thereof, thereby increasing assembly operation efficiency of the ignition coil.

In a further form of the invention, there is provided an ignition device for an internal combustion engine, wherein the conductive plate is formed of a non-magnetic material. This feature of the invention offers the following advantage. The conductive plate neither affects the magnetic field of the iron core nor disturbs magnetic properties of the iron core.

In a still further form of the invention, there is provided an ignition device for an internal combustion engine, wherein the iron core has a gap, and wherein a portion of the conductive plate is inserted in the gap. This feature of the invention offers the following advantage. The conductive plate acts as a spacer so that the size of the gap can be controlled without requiring preparation of a member for use in a spacer only.

What is claimed is:

1. An ignition device for an internal combustion engine which generates high voltage in a secondary coil based on a primary current passing through a primary coil of an ignition coil, and supplies the high voltage to an ignition plug of the internal combustion engine, wherein said ignition coil comprises:

an iron core formed by laminating a plurality of cut steel plates;

a primary coil including a primary bobbin wound around said iron core; and a conductive plate being arranged between said iron core and said primary bobbin of said primary coil, said conductive plate having a contact surface with which sections of said steel plates of said iron core are in contact and being electrically connected to an external ground terminal.

2. An ignition device for an internal combustion engine according to claim 1, wherein a raised portion is provided on said contact surface to contact said steel plates.

3. An ignition device for an internal combustion engine according to claim 1, wherein said iron core and said conductive plate have engaging means.

4. An ignition device for an internal combustion engine according to claim 2, wherein said iron core and said conductive plate have engaging means.

5. An ignition device for an internal combustion engine according to claim 1, wherein said conductive plate is formed of a non-magnetic material.

6. An ignition device for an internal combustion engine according to claim 2, wherein said conductive plate is formed of a non-magnetic material.

7. An ignition device for an internal combustion engine according to claim 3, wherein said conductive plate is formed of a non-magnetic material.

8. An ignition device for an internal combustion engine according to claim 1, wherein said iron core has a gap, and wherein a portion of said conductive plate is positioned in said gap.

9. An ignition device for an internal combustion engine according to claim 2, wherein said iron core has a gap, and wherein a portion of said conductive plate is positioned in said gap.

10. An ignition device for an internal combustion engine according to claim 3, wherein said iron core has a gap, and wherein a portion of said conductive plate is positioned in said gap.

11. An ignition device for an internal combustion engine according to claim 4, wherein said iron core has a gap, and wherein a portion of said conductive plate is positioned in said gap.

* * * * *